United States Patent [19]

Stone

[11] Patent Number: 4,512,755

[45] Date of Patent: Apr. 23, 1985

[54] APPARATUS FOR ERECTING A BOTTLE CARRIER

[75] Inventor: Orison W. Stone, Middlebury, Vt.

[73] Assignee: Pack Image, Inc., Middlebury, Vt.

[21] Appl. No.: 473,012

[22] Filed: Mar. 7, 1983

[51] Int. Cl.[3] ..... B31B 1/44

[52] U.S. Cl. ..... 493/92; 493/138; 493/167; 493/312; 493/912

[58] Field of Search ..... 493/138, 312, 90, 92, 493/167, 912, 913

[56] References Cited

U.S. PATENT DOCUMENTS

| | | | |
|---|---|---|---|
| 2,831,407 | 4/1958 | Pittman et al. | 493/312 |
| 3,038,387 | 6/1962 | Pearson | 493/912 X |
| 3,198,091 | 8/1965 | Fahey | 493/138 X |
| 3,343,466 | 9/1967 | Sherman | 493/312 |
| 3,541,930 | 11/1970 | Goodrich | 493/167 X |
| 4,111,105 | 9/1978 | Culpepper et al. | 493/912 X |
| 4,315,752 | 2/1982 | Moen | 493/92 X |

*Primary Examiner*—James F. Coan

*Attorney, Agent, or Firm*—Wood, Herron & Evans

[57] ABSTRACT

Apparatus for erecting a bottle carrier. The carrier is initially formed as a flat folded tube having a bottom wall, a top wall and transversely creased end walls, the top wall forming a central partition. The apparatus has a longitudinal partition former which is spaced to create a longitudinal slot and end formers which are spaced from the longitudinal formers to create end slots. A blade passing through a hole in the bottom wall engages the inside surface of the top wall to drive it into the longitudinal slot. This operation creates the central partition and simultaneously erects the end walls as the carrier is thrust into the forming apparatus.

4 Claims, 11 Drawing Figures

FIGURE 5
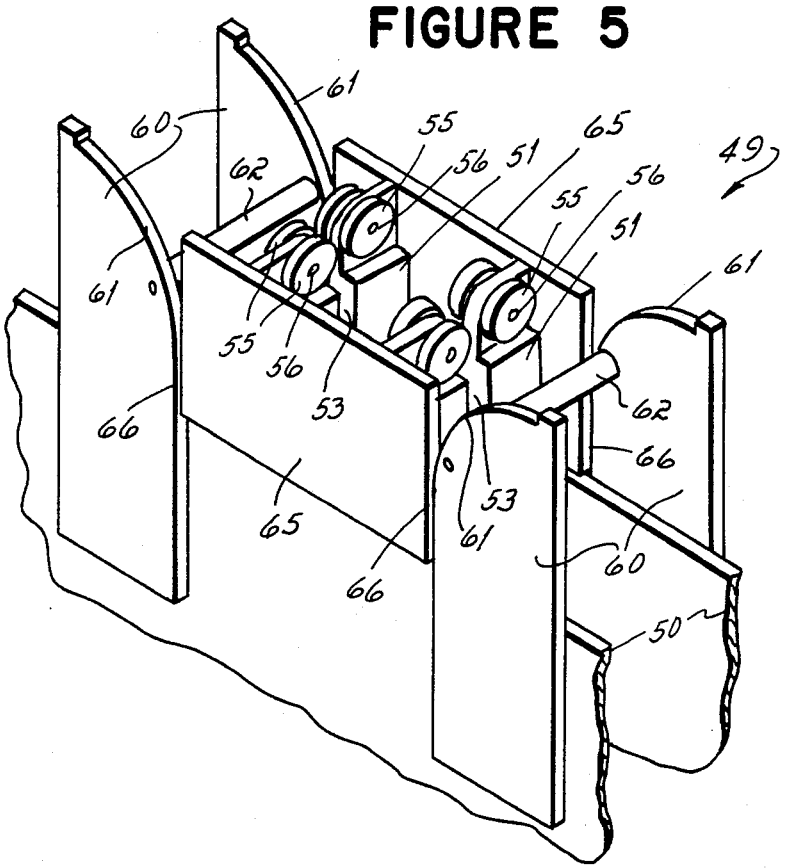
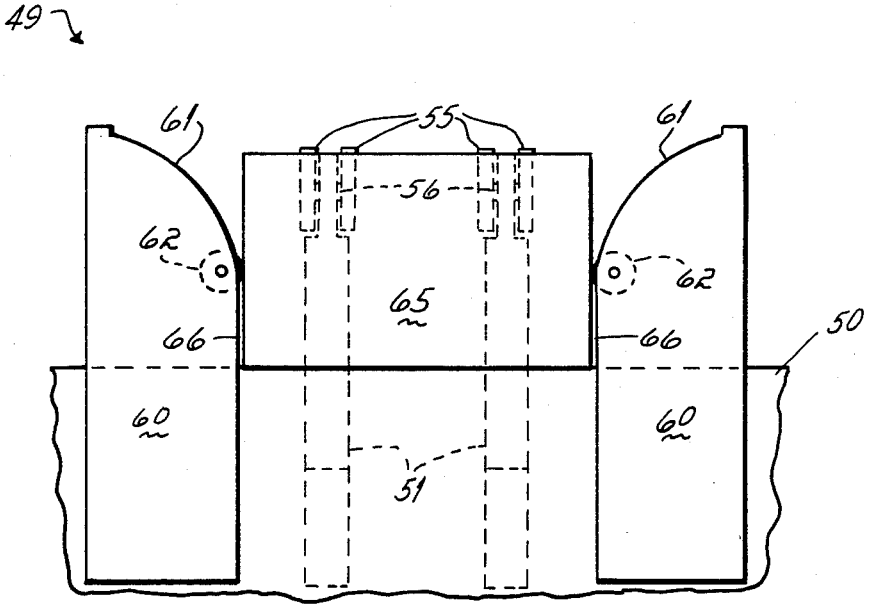
FIGURE 6

APPARATUS FOR ERECTING A BOTTLE CARRIER

This invention relates to apparatus for erecting bottle carriers, and more particularly, the invention relates to apparatus for erecting carriers of the type disclosed in copending application Ser. No. 270,108, filed June 3, 1981.

The carrier of that application is initially formed as a flat folded tube having a top wall, a bottom wall and two creased end walls which interconnect the top and bottom walls. Side wall forming panels are hinged to the bottom wall and end walls, respectively. The carrier is erected by simultaneously applying pressure to the end walls to erect them and to the top wall to form a central partition out of the top wall. A central transverse divider is formed by thrusting a V-shaped paperboard element into a hole in the bottom wall, as generally described in copending application Ser. No. 410,824 filed Aug. 23, 1982. Side walls are formed by applying glue to the panels hinged to the end walls and securing them to the major panels hinged to the bottom wall.

The objective of the present invention is to provide economical apparatus for erecting the carrier.

The objective is attained by providing forming apparatus having a pair of spaced longitudinal formers which create between them a longitudinal slot and a pair of end formers which are spaced from the longitudinal formers to create end slots. When a flat folded carrier is placed against the former with the top wall in engagement with the longitudinal formers, a blade thrust through an opening in the bottom wall against the inside surface of the top wall will force the top wall into the longitudinal slot, thereby creating the central partition. Simultaneously, the end formers will apply force to the creased end walls to erect them. Thus, in one movement of the plunger blade, a major portion of the erecting operation is performed.

It is preferred that the longitudinal formers have central gaps which will permit the introduction of the central divider while the carrier remains in its erected condition on the forming apparatus. Also, while the carrier is in the forming apparatus, the flaps hinged to the end walls may be folded inwardly and glue applied and the major side wall forming panel hinged to the bottom wall may be folded and held in contact with the flaps to complete the formation of the carrier.

Another feature of the invention has been to provide an improved central transverse divider and central partition combination.

The several features of the invention will become more readily apparent from the following detailed description taken in conjunction with the accompanying drawings in which:

FIG. 5 is a perspective view of the former;

FIG. 6 is a side elevational view of the former;

DESCRIPTION

Figure 1:
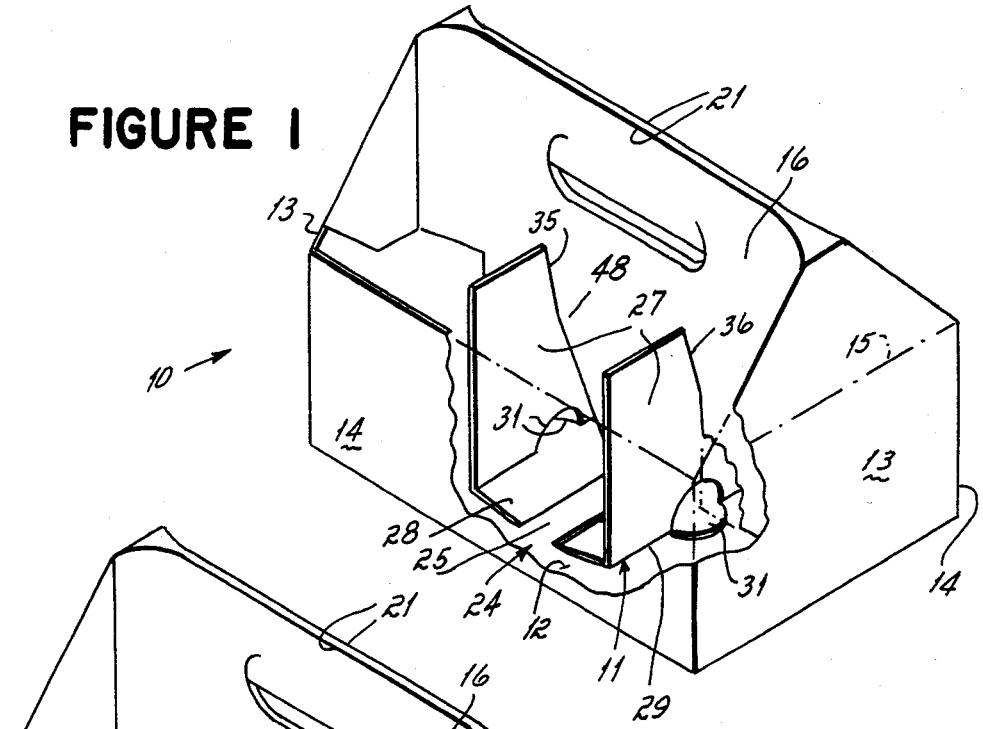
FIG. 1 is a partially broken away perspective view of a carrier to be formed in accordance with the present invention.
Figure 1:
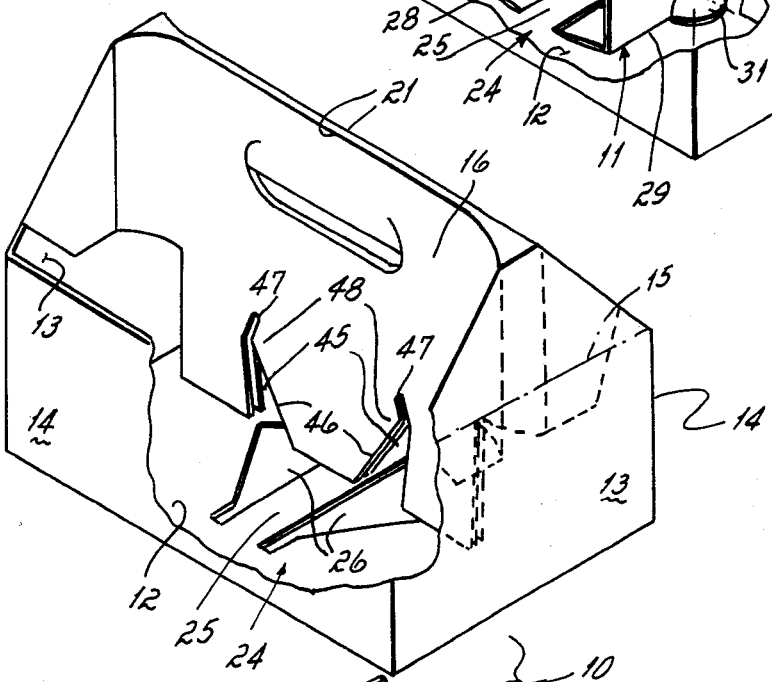

Referring to FIG. 1, the carrier is shown at 10 and has a divider 11 in the central portion of the carrier. The carrier has a bottom wall 12, two opposed end walls 13 and two opposed side walls 14. The end walls have transverse creases 15 which facilitate the erection of the carrier, as will be described. A central partition 16 is connected between the end walls 13 and is formed from two top wall panels 20 which are folded from a horizontal attitude down to a vertical attitude within the carrier along parallel creases 21. In order to erect the carton blank in a manner to be described and to accommodate the insertion of the divider 11, the bottom wall has a central opening 24. This opening may be bisected by a bridge 25 to present two openings 26 of substantial transverse dimension which permit the transverse divider 11 to be introduced through the opening in the bottom wall. The transverse divider is generally U-shaped and has two vertical walls 27 which are connected to a horizontal wall 28 along two cut scores 29. The cut scores are formed on the underside of the divider and permit the walls to swing easily to a position perpendicular to the horizontal wall. The horizontal wall also has a central crease 30.

The upper end portions of the walls 27 have V-shaped slots 35, 36.

The horizontal wall 28 has projecting semicircles 31 at its scored edges 29. The semicircles serve to close a portion of the opening 24 after the divider is inserted, as will be seen.

The central partition 16 has two spaced inverted V-shaped slots 45. Those slots have adjacent edges 46 which are downwardly and inwardly inclined toward the opening 24 and would, if extended, pass through the opening 24. They thus form guides which are engageable by the slots 35 and 36 of the divider 11 to slide the vertical walls of the divider into the proper position with the carrier so that they are vertical and spaced apart by approximately a bottle diameter. The upper portion of each slot 45 terminates in an inwardly-directed section 47 which creates an outwardly-projecting bulge 48 on the inclined edges 46. The bulge 48 assists in snapping the transverse divider into place, as will appear.

Figure 3:
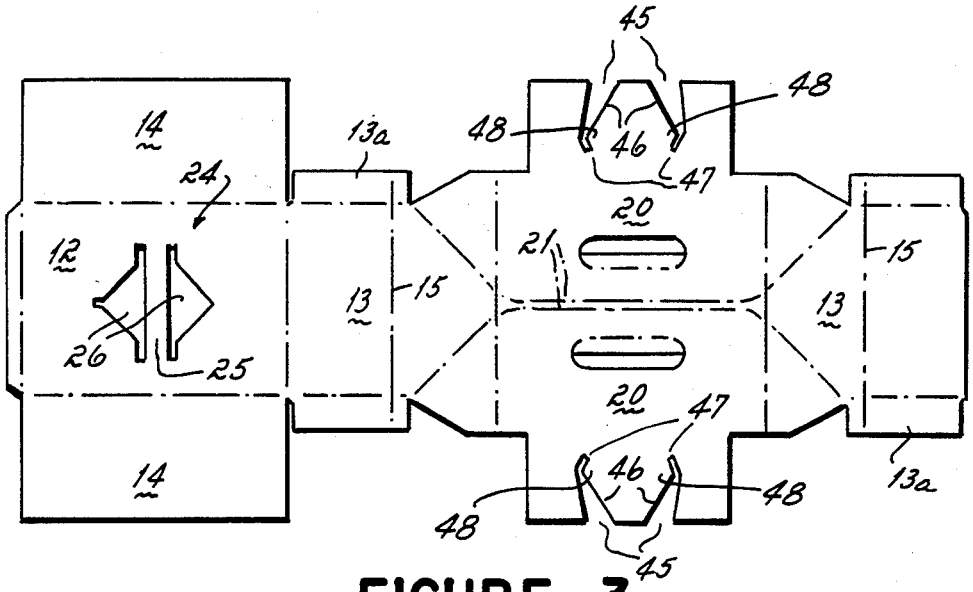
FIG. 3 is a plan view of a blank from which the carrier is formed.

The carrier is formed as follows: a one-piece blank is first cut, creased and scored as shown in FIG. 3. The carrier is then glued and folded to the condition shown in FIG. 4. As can be seen from that figure, the two top wall panels are as yet unformed into a central partition and directly overlie the bottom wall 12. The creased end walls are folded upon themselves along their transverse creases 15. The thus formed flat folded carrier is adapted to be erected or set up on the former. In the setting up of the carrier, forces will be simultaneously applied to the two top panels 20 and the upper sections of the creased end walls 13. Those forces effect the partial erection of the carrier. Thereafter, the transverse divider is inserted through the bottom opening and is snapped securely into the position shown in FIG. 1. All that remains thereafter is the gluing of the opposed side wall-forming panels 14 to side flaps 13*a* which are hinged to the end walls 13.

Figure 4:
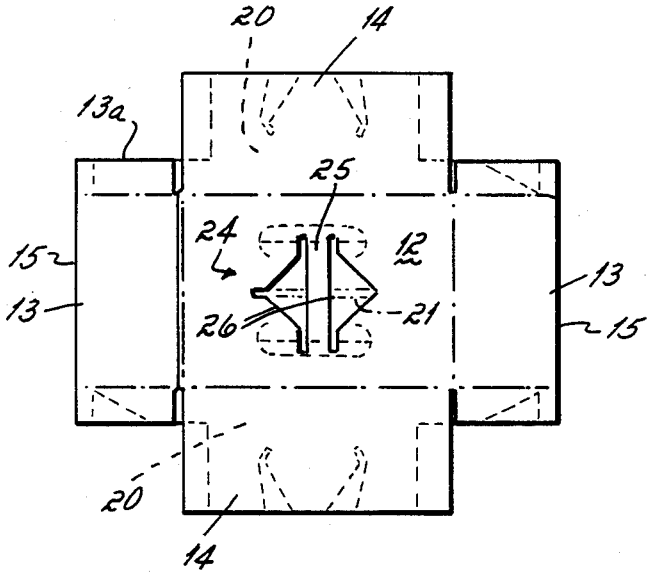
FIG. 4 is a plan view of a folded carrier adapted to be positioned on the former and thereafter erected.
Figure 7:
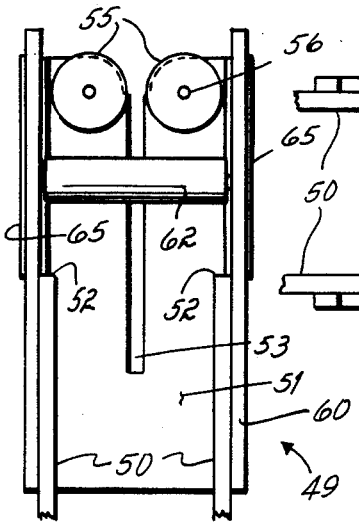
FIG. 7 is an end elevational view of the former.
Figure 8:
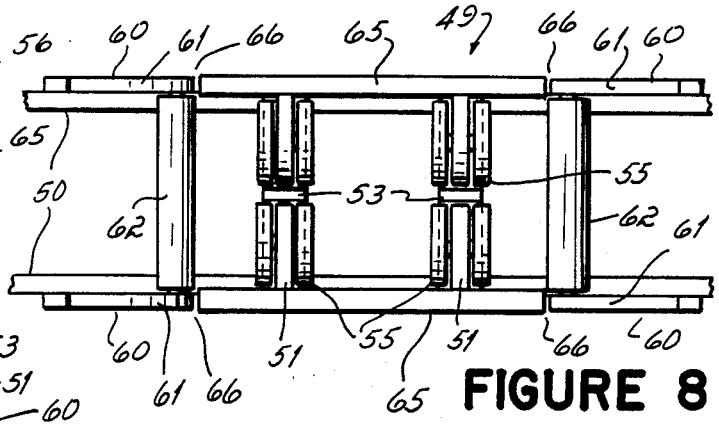
FIG. 8 is a top plan view of the former.
Figure 9:
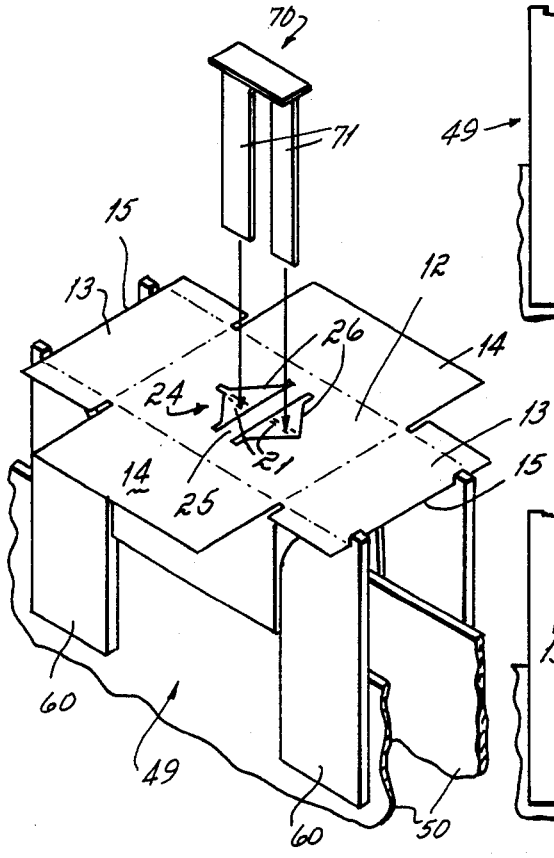
FIGS. 9–11 are diagrammatic perspective views of a sequence of steps showing the carrier being set up on the former.
Figure 10:
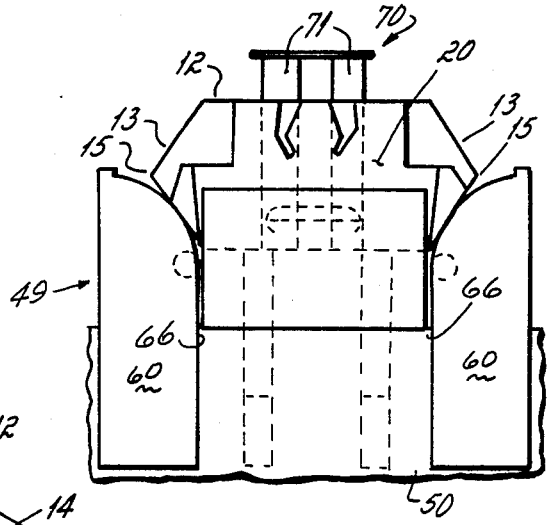
Figure 11:
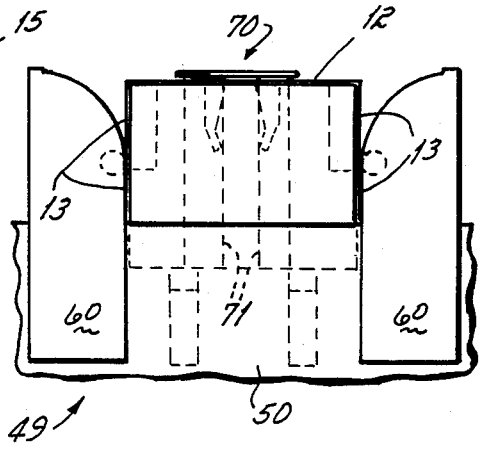

Starting with the blank as depicted in FIG. 4, the blank is erected as illustrated in FIGS. 9–11 on the former 49 illustrated in FIGS. 5–8. The former 49 has a base consisting of two spaced parallel plates 50 which are suitably interconnected and which would be mounted on automatic machinery for erecting the carton. Two spaced cross plates 51 are bolted internally between the base plates 50. The cross plates have shoulders 52 which rest upon the top surfaces of the base plates 50. Each cross plate 51 has a deep vertical slot 53 into which the top panels 20 will be forced in order to form the central partition. Anti-friction rollers 55 are rotatably secured on shafts 56 to the top portions of the cross plates 51, the rollers effectively becoming the longitudinal formers for the forming apparatus.

A pair of end plates 60 are mounted at each end of the apparatus. They are bolted to the base plates 50. At the upper portion of each of the end plates 60 is an arcuate forming surface 61 which terminates at its lower end in an elongated transverse roller 62. The combination of the arcuate surface 61 and the roller 62 effectively becomes an end former for the apparatus.

Side walls 65 rest upon the top surface of the base plate 50 and are bolted to the vertical edges of the cross plates 51 to complete the formation of the apparatus. The side plates provide a surface upon which the side wall-forming panels can be pressed when the side walls are glued to the flaps 13*a* hinged to the end walls of the carrier. The end edges of the side walls 65 are spaced from the end plates 60 a distance, indicated at 66, sufficient for gusset structure of the carrier to project into during the formation of the carrier.

Referring to FIG. 9, a plunger 70 having a pair of blades 71 is mounted adjacent the apparatus with the blade being aligned with the slots 53 in the cross plates 51. A mechanism, not shown, is provided for thrusting the plunger into the slot 53 in order to drive the top panels 20 of the carrier into the former to form the central partition 16.

In the formation of the carrier, a flat folded carrier, as shown in FIGS. 4 and 9, is placed upon the apparatus with the top wall panels 20 lying on the apparatus 49 and the parallel creases 21 in alignment with the slots 53. The plunger 70 is then driven into the slot 53. In so doing, the blades pass through the openings 26 in the bottom wall and engage the top wall panels 20 between the two parallel creases 21. As the thrust of the plunger into the apparatus continues, the top panels 20 pass over the rollers 55 and are forced together to form the central partition 16. Simultaneously, the upper sections of the end walls 13 pass over the arcuate surface 61 and the roller 62 associated with the end plates 60, thereby forcing the two sections of the end wall of the carrier to assume an erect attitude. The intermediate stage of the formation of the carrier is depicted in FIG. 10.

As the plunger 70 comes to the end of its stroke into the apparatus, the central partition of the carrier is formed and the end walls of the carrier are erect as depicted in FIG. 11.

Figure 2:
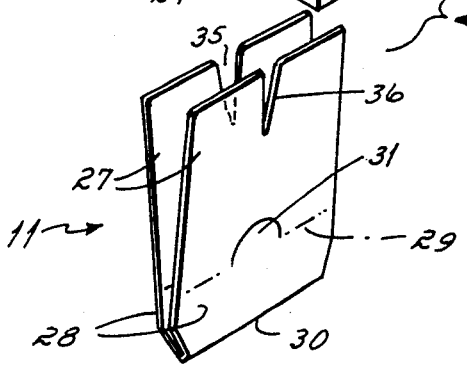
FIG. 2 is a disassembled perspective view similar to FIG. 1 illustrating the assembly of the transverse dividers.

When the carrier is erected as depicted in FIG. 11, the plunger 70 is withdrawn. A divider 11 in a V-shaped configuration of FIG. 2 is inserted in the opening 24 with one wall 27 going into each opening 26. The V slots 35 and 36 of the divider engage the inclined edges 46 to guide the divider into the carrier. As the walls 27 ride over the bulges 48 on the edges 46, the walls tend to be cammed outwardly, creating a bias on the walls. When the scores 29 pass through the openings 26, the bias on the walls 27 causes the divider to snap into a U-shaped configuration consisting of the horizontal wall and the two vertical walls. This snapping into position securely locks the divider in the carrier.

With the divider in place the flaps 13*a* are folded at right angles and glue is applied to them. The wall-forming panels 14 are then folded down into engagement with the flaps and are glued to them, thus completing the formation of the carrier.

Having described my invention, I claim:

1. Apparatus for forming a carrier, longitudinal formers spaced apart to form a longitudinal slot for receiving and folding a central partition, formers across the ends of said longitudinal slot for engaging transversely-creased end walls to erect said end walls, said end formers being spaced longitudinally from said longitudinal formers to provide transverse slots for the formation of gussets between said central partition and end walls, a thin plunger, means for passing said plunger into said longitudinal slot and between said end formers, said thin plunger being engageable with said central partition to drive it into said longitudinal slot thus folding said central partition upon itself and simultaneously effecting partial erection of said carrier by said longitudinal and end formers simultaneously applying forces to said central partition and end walls.

2. Apparatus as in claim 1 in which each said longitudinal former has a central gap to permit the insertion of a divider while said carrier is in the forming apparatus.

3. Apparatus as in claim 1 further comprising, anti-friction rollers mounted on the longitudinal and end formers to facilitate the movement of said carrier into said carrier under the thrust of said plunger.

4. Apparatus for forming a carrier from a flat folded tubular member having a bottom wall, a top wall for forming a central partition, and transversely-creased end walls interconnecting said bottom and top walls, said apparatus comprising, longitudinal formers spaced apart to form a longitudinal slot for receiving and folding said central partition, formers at the ends of said longitudinal slot for engaging said transversely-creased end walls to erect said end walls, said end formers being spaced from said longitudinal formers to provide transverse slots for the formation of gussets between said central partition and end walls, and a thin plunger engageable with said top wall through an opening in said bottom wall when said tubular member is placed on said apparatus with said top and end walls engaging said formers to drive said top wall into said longitudinal slot and effect creation of said central partition and erection of said end walls.

* * * * *